US012264894B2

(12) United States Patent
Overfelt

(10) Patent No.: US 12,264,894 B2
(45) Date of Patent: Apr. 1, 2025

(54) AIMING DEVICE WITH LIGHT SENSOR

(71) Applicant: BUSHNELL INC., Overland Park, KS (US)

(72) Inventor: Travis C. Overfelt, Lee's Summit, MO (US)

(73) Assignee: Bushnell Inc., Overland Park, KS (US)

( * ) Notice: Subject to any disclaimer, the term of this patent is extended or adjusted under 35 U.S.C. 154(b) by 0 days.

(21) Appl. No.: 18/195,248

(22) Filed: May 9, 2023

(65) Prior Publication Data

US 2024/0377161 A1 Nov. 14, 2024

(51) Int. Cl.
*F41G 1/30* (2006.01)

(52) U.S. Cl.
CPC ..... *F41G 1/30* (2013.01)

(58) Field of Classification Search
CPC ..... F41G 1/30; F41G 1/345; F41G 1/38
See application file for complete search history.

(56) References Cited

U.S. PATENT DOCUMENTS

| | | | | |
|---|---|---|---|---|
| 2,441,823 | A | 5/1948 | Kurlander | |
| 3,880,529 | A | 4/1975 | Althause et al. | |
| 5,653,034 | A | 8/1997 | Bindon | |
| 6,807,242 | B1 | 10/2004 | Schick et al. | |
| 8,713,845 | B1 | 5/2014 | Stenton | |
| 11,466,960 | B2 | 10/2022 | Noskowicz | |
| 2010/0083554 | A1 | 4/2010 | Elpedes et al. | |
| 2022/0196366 | A1 * | 6/2022 | Beckman | F41G 3/12 |
| 2023/0035329 | A1 | 2/2023 | Noskowicz | |
| 2023/0176388 | A1 * | 6/2023 | Parker | G02B 27/0189 359/13 |

* cited by examiner

*Primary Examiner* — J. Woodrow Eldred
(74) *Attorney, Agent, or Firm* — Reed Smith LLP; Walter M. Egbert, III; Richard J. Brown

(57) ABSTRACT

An optical aiming device for mounting on a firearm is provided, having a housing defining a barrel axis; an optical element received in the housing; an illumination device being arranged to project light onto the optical element to display a reticle, the reticle having a first light intensity; a light sensor arrangement comprising a first sensor defining a first effective detector angle of view and providing a first sensor signal and a second sensor defining a second effective detector angle of view and providing a second sensor signal, the light sensor arrangement being arranged to cooperate with the illumination device to enable adjustment of the light intensity of the reticle to a second light intensity as a function of the first and second sensor signals; and a processor configured to communicate with the light sensor arrangement to adjust the light intensity of the reticle as a function of the first and second sensor signals.

20 Claims, 7 Drawing Sheets

AIMING DEVICE WITH LIGHT SENSOR

FIELD OF THE DISCLOSURE

The present disclosure relates to optical aiming devices and, in particular, to reflex sights having a light sensor arrangement to provide compensation for display intensity.

BACKGROUND

Reflex sights, or reflector sights, are optical sights that are commonly used with firearms, such as handguns and small arms. Reflex sights are also used with surveying equipment, optical telescopes and camera viewfinders. Reflex sights include a partially reflecting optical element, such as a lens or flat glass element that allows the user to view a target and an illuminated aiming mark or reticle pattern superimposed on the field of view. In a reflex sight commonly referred to as a "red-dot" (or "green dot") sight, the aiming mark is typically generated by a small light emitting diode (LED) at the focal point of the lens, which is typically treated with a dichroic coating to selectively reflect the wavelength of the illumination. In reflex sights including a flat glass element, the aiming mark is generated by an illumination source directed through collimating optics toward the flat glass element.

Some reflex sights utilize a photodetector to turn on and/or modulate the LED intensity that projects onto the lens and reflects back to the user's eye(s). While there are several types of photodetectors, commonly utilized types for this application are photoresistor/photocell, phototransistor, or a photodiode. Typically, a photodetector points up or forward or to the side. Such photodetectors are normally omnidirectional and used to detect ambient lighting conditions near the reflex sight and the user's location. Omnidirectional photodetectors are often adequate for detecting local brightness conditions. The conventional arrangement provides sufficient intensity compensation for a room with consistent/homogenous lighting or an outdoor setting made consistent by sunlight.

However, lighting conditions that include a disparity in light intensity between the user/reflex sight and the target location can pose challenges to providing proper illumination. For example, the user may be in relatively dim local conditions with bright target lighting. The user may be operating in a dimly lit indoor range having target carriage lighting or an outdoor range with a covered or shaded shooting platform, but without cover over targets fully exposed to the sun. In other circumstances, the user may be positioned within a shaded tree line and aiming out into a bright sunlit field. Further, a user may be in a dim or dark scenario where a bright tactical handheld flashlight or weapon-mounted light is deployed. When the target is brightly illuminated, the aiming point of the reticle may be washed out and thus difficult to view. Conversely, relatively bright local conditions with dim target lighting may present itself, such as a well-lit room or outdoor area when aiming into a darker environment such as a dark hallway or into a shaded tree line. Conventional reflex sights that rely on a single sensor have difficulty modulating the LED intensity in these more challenging lighting conditions. Thus, there is a need for an improved reflex sight having features that modulate LED intensity in a way that maintains acceptable user visibility of the reticle/aiming point.

SUMMARY

An aspect of the present disclosure provides an optical aiming device for mounting on a firearm comprising: a housing defining a barrel axis; an optical element received in the housing; an illumination device being arranged to project light onto the optical element to display a reticle on the optical element, the reticle having a first light intensity; a light sensor arrangement comprising a first sensor defining a first effective detector angle of view and providing a first sensor signal and a second sensor defining a second effective detector angle of view and providing a second sensor signal, the light sensor arrangement being arranged to cooperate with the illumination device to enable adjustment of the light intensity of the reticle to a second light intensity as a function of the first and second sensor signals; and a processor configured to communicate with the light sensor arrangement to adjust the light intensity of the reticle as a function of the first and second sensor signals.

In some embodiments, the optical aiming device is an optical reflex sight, a riflescope or a prism sight.

In some embodiments, the first sensor is aimed in a first direction substantially parallel to the barrel axis and the second sensor is aimed in a second direction different from the first direction.

In some embodiments, the first effective detector angle of view is narrower than the second effective detector angle of view. In some embodiments, the first sensor is a directional sensor and the second sensor is an omnidirectional sensor. In some embodiments, the first effective detector angle of view is between 15 and 90 degrees and the second effective detector angle of view is between 120 and 180 degrees.

In some embodiments, the processor is configured to operate the light intensity of the reticle according to a first sensitivity of the first sensor signal when the second sensor signal is above a first light threshold and wherein the processor is configured to operate the light intensity of the reticle according to a second sensitivity of the first sensor signal when the second sensor signal is below a second light threshold. In some embodiments, the first sensitivity is a first factor applied to the first sensor signal. In some embodiments, the second sensitivity comprises a second factor applied to an increase in the first sensor signal and a third factor applied to a decrease in the first sensor signal.

In some embodiments, the optical aiming device further includes an IR sensor.

In some embodiments, the optical aiming device further includes a network adapter to transmit data from the optical aiming device to a remote device. In some embodiments, the optical aiming device further includes a network adapter to receive data from a remote device such as a flashlight or other external illumination device or a remote computing device. For example, the optical reflex sight can be triggered by a flashlight.

In some embodiments, the second sensor is powered by a photovoltaic cell. In some embodiments, the second sensor is a photovoltaic cell.

In some embodiments, the optical aiming device further includes an accelerometer, and wherein the accelerometer is configured to provide inclination angle of the aiming device and wherein processor suspends adjustment of the light intensity of the reticle as a function of the first and second sensor signals when the inclination angle exceeds a predetermined angle.

Another aspect of the present disclosure provides an optical aiming device for mounting on a firearm having a housing defining a barrel axis; an optical element received in the housing; an illumination device being arranged to project light onto the optical element to display a reticle on the optical element, the reticle having a first light intensity; a light sensor arrangement comprising a directional sensor providing a first sensor signal and omnidirectional sensor providing a second sensor signal, the light sensor arrangement being arranged to cooperate with the illumination device to enable adjustment of the light intensity of the reticle to a second light intensity as a function of the first and second sensor signals.

In some embodiments, the optical aiming device is an optical reflex sight, a riflescope or a prism sight.

In some embodiments, the directional sensor defines an effective detector angle of view is between 15 and 90 degrees and the omnidirectional sensor defines an effective detector angle of view is between 120 and 180 degrees. In some embodiments, the directional sensor is aimed in a first direction substantially parallel to the barrel axis and the omnidirectional sensor is aimed in a second direction different from the first direction.

In some embodiments, the light intensity of the reticle is operated according to a first sensitivity of the first sensor signal when the second sensor signal is above a first light threshold and the light intensity of the reticle is operated according to a second sensitivity of the first sensor signal when the second sensor signal is below a second light threshold.

In some embodiments, the first sensitivity is a first factor applied to the first sensor signal. In some embodiments, the second sensitivity comprises a second factor applied to an increase in the first sensor signal and a third factor applied to a decrease in the first sensor signal.

A further aspect of the present disclosure provides an optical reflex sight for mounting on a firearm having a housing defining a barrel axis; an optical element received in the housing; an illumination device being arranged to project light onto the optical element to display a reticle on the optical element, the reticle having a first light intensity; a light sensor arrangement comprising a directional sensor aimed in a direction substantially parallel to the barrel axis providing a first sensor signal and an omnidirectional sensor signal aimed in a second direction providing a second sensor signal, the light sensor arrangement being arranged to cooperate with the illumination device to enable adjustment of the light intensity of the reticle as a function of the first and second sensor signals; and a processor configured to communicate with the light sensor arrangement to operate the light intensity of the display as a function of the detected parameter, wherein the processor is configured to operate the light intensity of the reticle according to a first sensitivity of the first sensor signal when the second sensor signal is above a first light threshold and to operate the light intensity of the reticle according to a second sensitivity of the first sensor signal when the second sensor signal is below a second light threshold.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
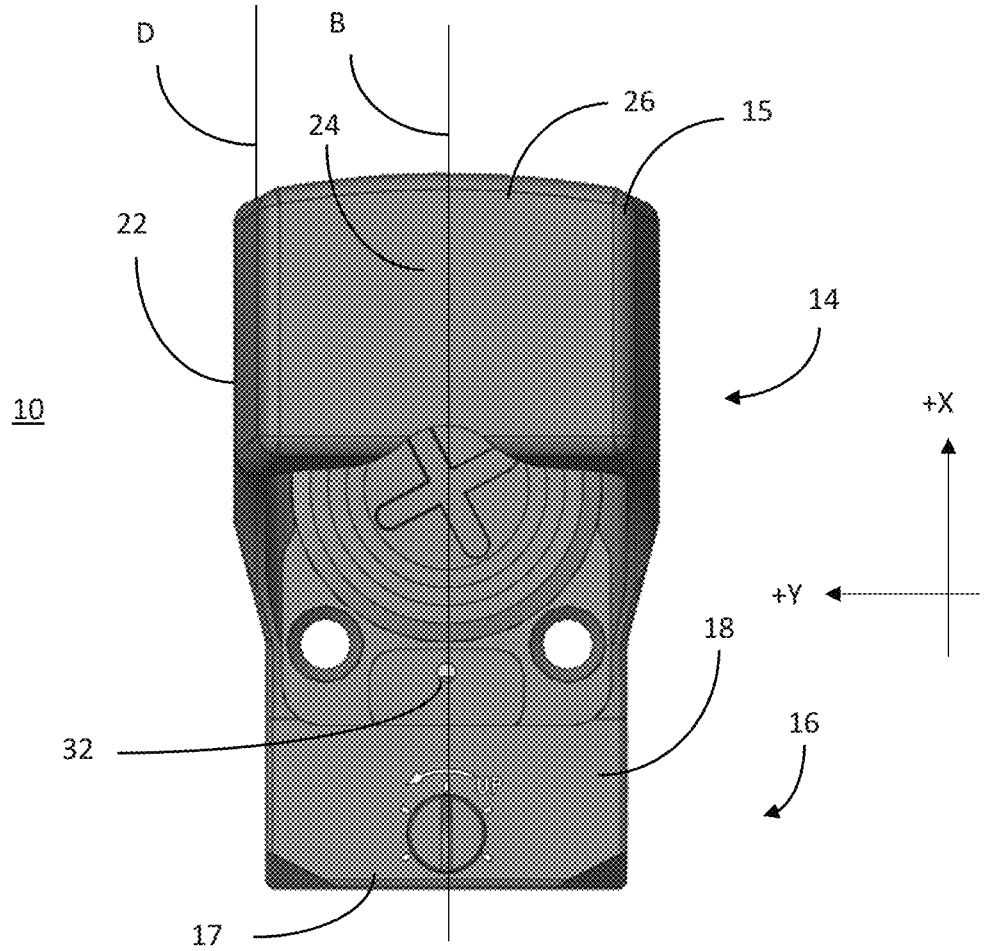
FIG. 1 is a top view of a reflex sight in accordance with an exemplary embodiment of the disclosed subject matter.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

It is to be understood that both the foregoing general description and the following detailed description are exemplary and explanatory only, and are not restrictive of the invention, as claimed. The following includes definitions of selected terms employed herein. The definitions include various examples and/or forms of components that fall within the scope of a term and that may be used for implementation. The examples are not intended to be limiting. Further, one having ordinary skill in the art will appreciate that the components discussed herein, may be combined, omitted or organized with other components or organized into different architectures.

In this description, the use of the singular includes the plural, the word "a" or "an" means "at least one," and the use of "or" means "and/or," unless specifically stated otherwise. Furthermore, the use of the term "including," as well as other forms, such as "includes" and "included" is not limiting. Also, terms such as "element" or "component" encompass both elements or components comprising one unit and elements or components that comprise more than one unit unless specifically stated otherwise. The use of the term "or" in the claims and the present disclosure is used to mean "and/or" unless explicitly indicated to refer to alternatives only or the alternatives are mutually exclusive.

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," "substantially," or the like, when accompanying a numerical value or direction are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments. No language in the specification should be construed as indicating any unclaimed element as essential to the practice of the embodiments.

A "processor", as used herein, processes signals and performs general computing and arithmetic functions. Signals processed by the processor may include digital signals, data signals, computer instructions, processor instructions, messages, a bit, a bit stream, or other means that may be received, transmitted, and/or detected. Generally, the processor may be a variety of various processors including multiple single and multicore processors and co-processors and other multiple single and multicore processor and co-processor architectures. The processor may include various modules to execute various functions. For example, a processor is configured to receive and execute various routines, programs, objects, components, logic, data structures, and so on to perform particular tasks or implement particular abstract data types.

A "memory", as used herein, may include volatile memory and/or non-volatile memory. Non-volatile memory may include, for example, ROM (read only memory), PROM (programmable read only memory), EPROM (erasable PROM), and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDRSDRAM), and direct RAM bus RAM (DRRAM). The memory may store an operating system that controls or allocates resources of a computing device. In one or more embodiments, memory includes any media that is accessible to the electronic circuitry in the connected device. For example, in some embodiments, memory includes computer readable media located locally in the connected device and/or media located remotely to the riflescope 100 and accessible via a network.

A "disk" or "drive", as used herein, may be a magnetic disk drive, a solid-state disk drive, a floppy disk drive, a tape drive, a Zip drive, a flash memory card, and/or a memory stick. Furthermore, the disk may be a CD-ROM (compact disk ROM), a CD recordable drive (CD-R drive), a CD rewritable drive (CD-RW drive), and/or a digital video ROM drive (DVD-ROM). The disk may store an operating system that controls or allocates resources of a computing device.

A "database", as used herein, may refer to a table, a set of tables, and a set of data stores (e.g., disks) and/or methods for accessing and/or manipulating those data stores.

Figure 2:
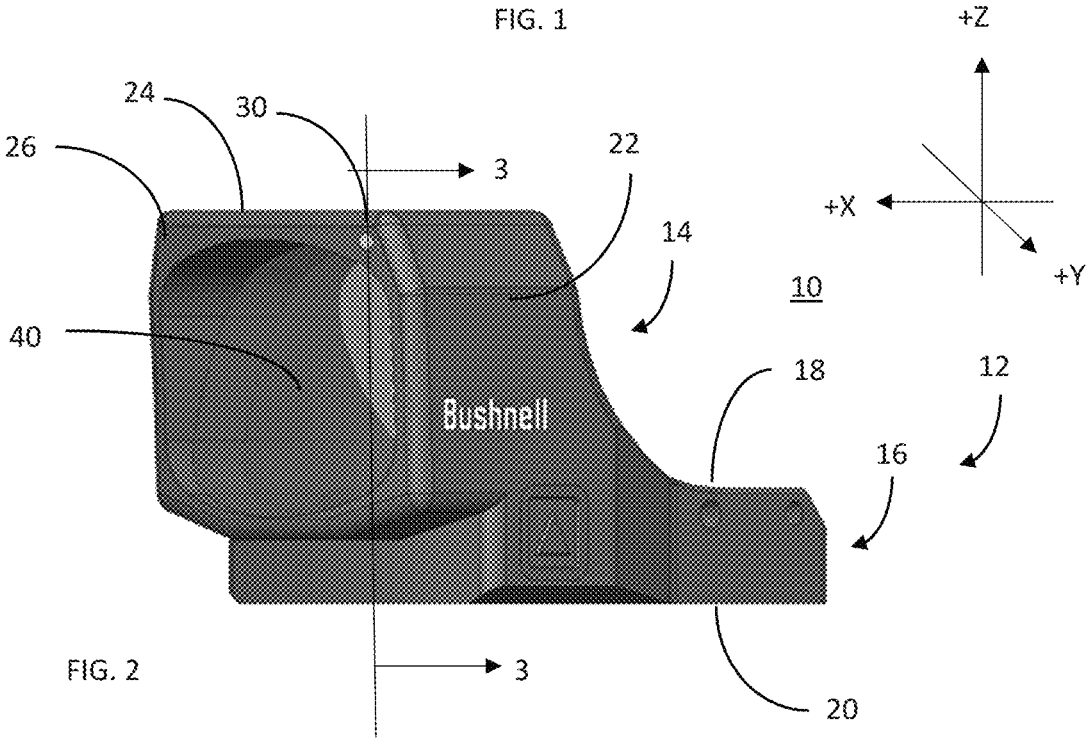
FIG. 2 is a side perspective view from the barrel end of the reflex sight of FIG. 1.

FIGS. 1-2 illustrate an optical aiming device 10 in accordance with an exemplary embodiment, for mounting to a handgun or other firearm (not shown). In some embodiments, the optical aiming device is an optical reflex sight, a riflescope, a prism scope and the like. Optical aiming device 10 overcomes the condition of dim ambient lighting conditions when a bright flashlight is used. Reflex sight 10 balances any lighting conditions and provides for an automatic system to provide adequate intensity in nearly all scenarios. This allows the user to keep their hands on the firearm rather than reposition to adjust reticle brightness on the sight. For reference purposes only, the 'X' direction is designated a forward/barrel direction, and the '−X' direction designated a rearward direction. The 'Z' direction is designated an upward direction, and the '−Z' direction is designated a downward direction. The 'Y' direction is designated a 'left' or 'port' direction, and the '−Y' direction is designated a 'right' or 'starboard' direction.

As illustrated in FIGS. 1-2, reflex sight includes a housing 12 having a frame portion 14 and a base portion 16. The housing 12 includes a barrel end 15 and a rear end 17. The barrel end is closest to the firearm barrel when mounted and the rear end 17 is closest to the eye of the user. A barrel axis B extends from the barrel end 15 to the rear end 17, and can also be the optical axis. The base portion 16 includes an upper surface 18 and a lower surface 20 for mounting on a firearm. The frame portion 14 includes side walls 22 and an upper wall 24. The forward/barrel side of the frame includes a front edge 26. An optical element 40 is mounted in a generally upright position in a forward portion of frame 14, providing a viewing window for a target field of view. Light emitted from the illumination device such one or more LEDs (122, FIG. 4) is directed at a focal point rearward of lens 40 and is reflected rearward toward the user's eye by a dichroic reflection layer or coating of at least one of lenses as collimated light, to provide a reticle, e.g., the user perceives the reflected light as an illuminated aiming mark superimposed on the field of view at infinite distance. Throughout the description, reticle, aiming mark and aiming point are used interchangeably. The light reflecting layer or coating preferably reflects light having a wavelength of about 650 nm±10 nm, which is generally seen as red light. However, other light intervals may be used; light perceived as yellow, green, blue or orange for example. Optionally, the color of the light can be determined by the choice of light source or combinations thereof. The illumination device 122 can be a light emitting diode (LED), a laser or the like, with either an external or internal power source, with respect to the reflex sight. A lithium battery or any other type of portable power source 101 or battery, can be incorporated into the base 16. As illustrated in FIG. 2, the bottom surface 20 of the sight 10 is adapted for placement on the firearm. The surface 20 may be flat or curved to conform to the shape of the barrel of the firearm.

Reflex sight 10 includes a light sensor arrangement including a directional, forward-aimed sensor 30 and an omnidirectional sensor 32. Forward-aimed sensor 30 is aimed along a directional axis D that is substantially parallel to the barrel axis B, and thus is aimed/directed towards the intended target to which the firearm is aimed. In some embodiments, the forward-aimed sensor 32 is positioned on the front edge 26 of the frame 14, e.g., near the corner of the intersection of the side wall 22 and the upper wall 24. Forward-aimed sensor 30 measures lighting condition at distance from a narrower field of view, e.g., the intended target. Forward-aimed sensor 30 is typically a photodiode having a narrow sensing field. The forward-aimed sensor angle of view is 15 degrees to 90 degrees in an exemplary embodiment. In some embodiments, the sensor angle field of view is any subset of ranges between 15 degrees to 90 degrees, including 15 degrees to 25 degrees, 25 degrees to 35 degrees, 35 degrees to 45 degrees, 45 degrees to 55 degrees, 55 degrees to 65 degrees, 65 degrees to 75 degrees, 75 degrees to 85 degrees, 85 degrees to 90 degrees, 25 degrees to 80 degrees, 30 degrees to 60 degrees, 45 degrees to 90 degrees.

Figure 3A:
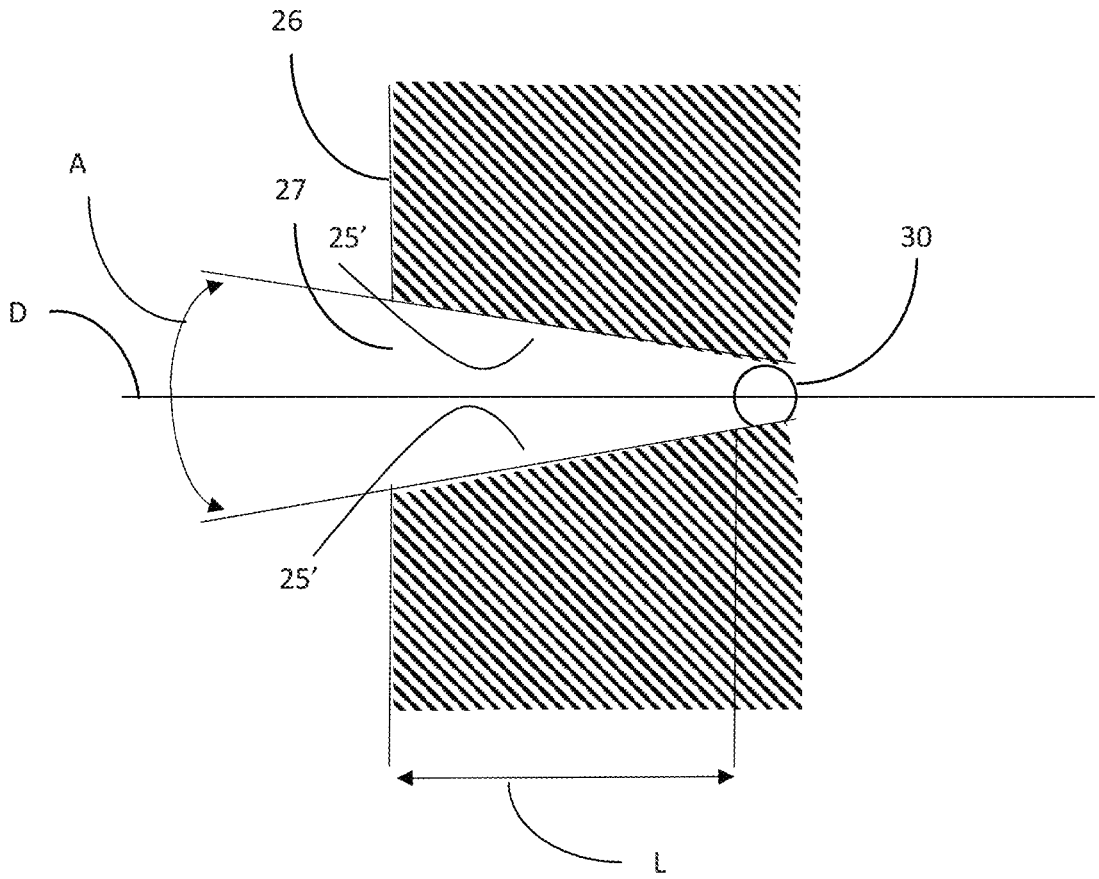
FIG. 3A is a cross-sectional view of the reflex sight of FIG. 1, taken through line 3-3 of FIG. 2.
Figure 3B:
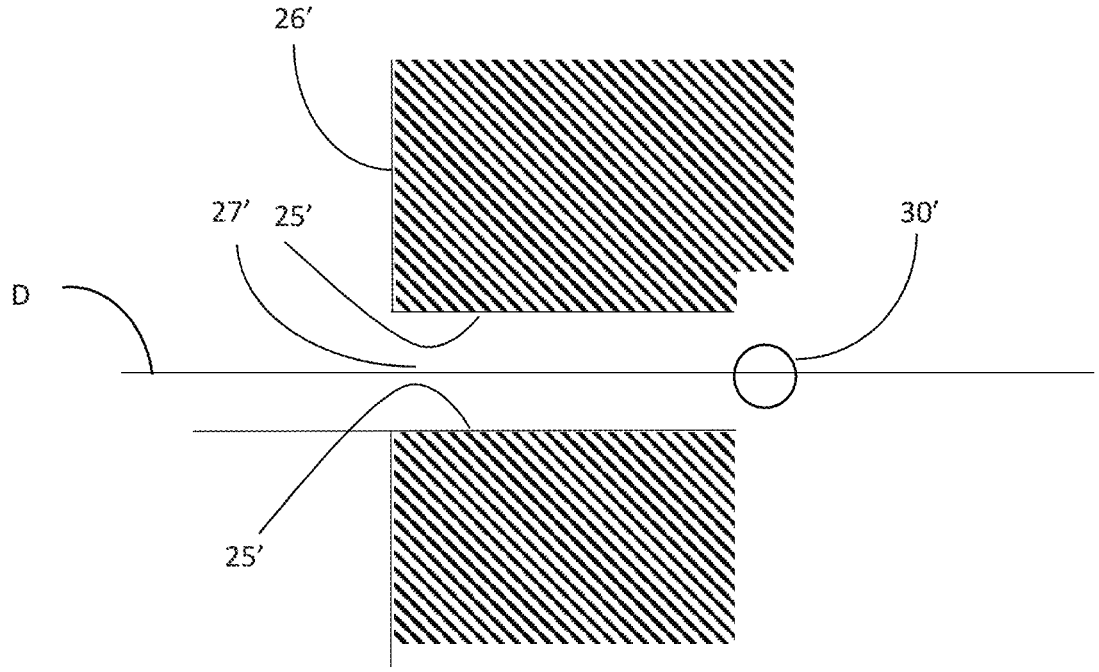
FIG. 3B is a cross-sectional view taken through line 3-3 of FIG. 2 in accordance with another exemplary embodiment.

As illustrated in FIG. 3A, the sensor 30 can be set back in a recess 27 at distance L from the front edge 26 of the frame 14. In an exemplary embodiment, the distance L is 1.5 mm to inset sensor 30 and provide a pocket for clear epoxy to seal the sensor against ingress. In an exemplary embodiment, distance L is 3 mm to 4 mm, and the recess 27 serves as an aperture stop. The angle between the A ranges from 0 degrees to 60 degrees, and all angle ranges therebetween. The angle A is selected as 60 degrees to recess and protect the sensor 30, but not hinder the sensor's design angle. The angle A is selected to complement the sensor angle field of view. In some embodiments, the directional sensor 30' serves as an aperture stop (FIG. 3B). Angle A is selected as 0 degrees from the directional axis D (e.g., the walls 25' of the recess 27' are substantially parallel.

Omnidirectional sensor 32 is typically a photodiode that receives ambient light over a wider sensing field. The omnidirectional sensor 32 detects local, ambient light conditions. Thus, in some embodiments, the sensor 32 is positioned on the upper surface 18 of the base 16. The sensor 32 can be aimed in a different direction than the directional sensor 30. For example, sensor 32 can be aimed orthogonally to the directional axis, e.g., upwardly, downwardly, rearwardly or to the sides of the sight 10. The sensor 32 can be aimed in other non-orthogonal directions different from the directional axis. The omnidirectional sensor 32 angle of view is greater than the directional sensor 30 angle of view, e.g., 120 degrees to 180 degrees in an exemplary embodiment. In some embodiments, the omnidirectional sensor angle field of view is any subset of ranges between 120 degrees to 180 degrees, including 120 degrees to 130 degrees, 130 degrees to 140 degrees, 140 degrees to 150 degrees, 150 degrees to 160 degrees, 160 degrees to 170 degrees, 170 degrees to 180 degrees, 125 degrees to 175 degrees, 130 degrees to 170 degrees, 140 degrees to 169 degrees.

By utilizing both a forward, directional sensor 30 and an omnidirectional sensor 32, more information may be gathered. When combined with an algorithm for different scenarios of inputs, the system can operate to provide solutions for more lighting conditions. A processor (102, FIG. 4) such as an electronic control unit ECU, microprocessor or CPU, is arranged in working cooperation with the light sensor arrangement 30, 32 and the illumination device 122 to adjust the intensity of the reticle as a function of the detected light intensity detected by sensors 30 and 32.

Figure 4:
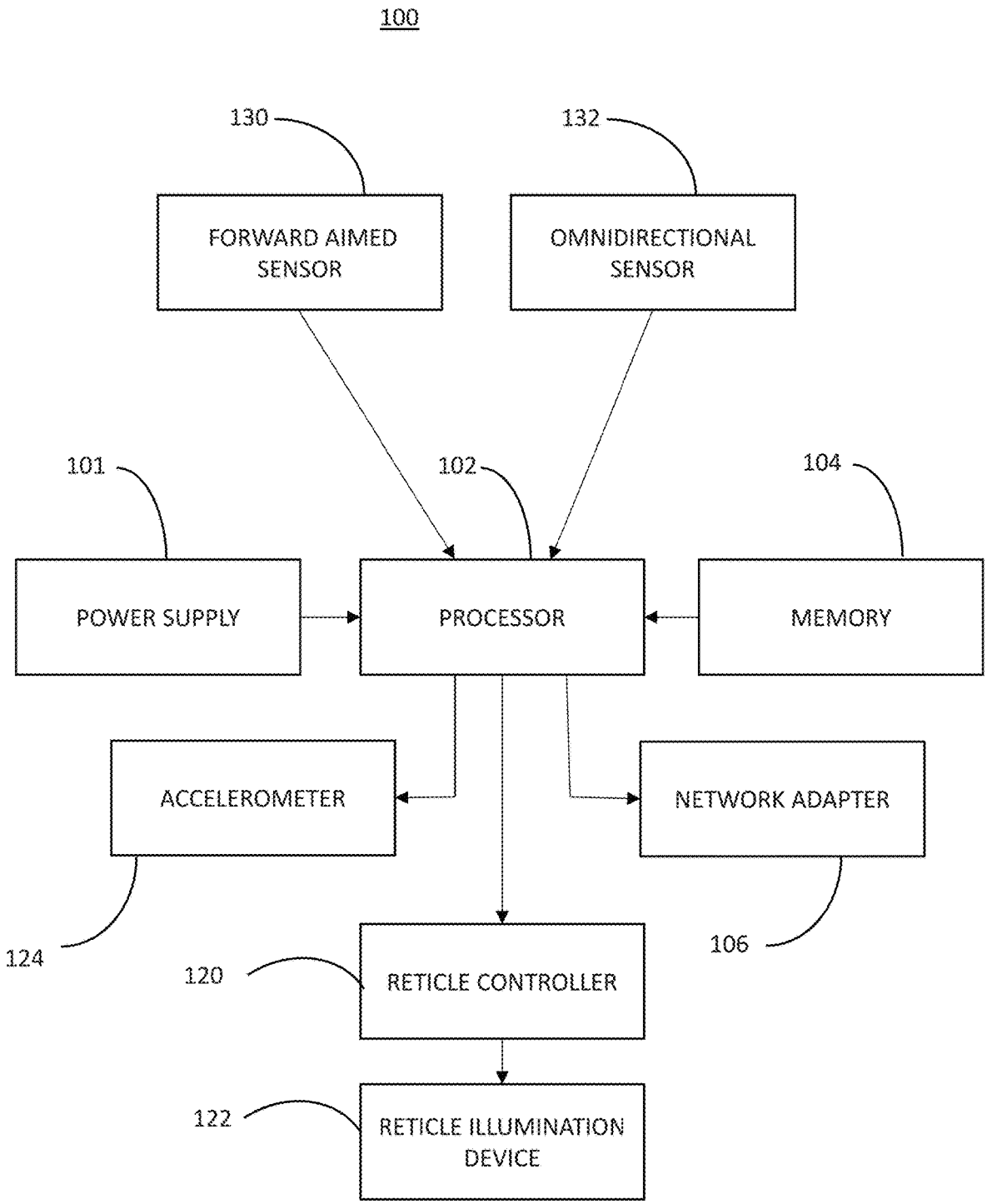
FIG. 4 is a simplified schematic view of the electronic components of the reflex sight of FIG. 1.

FIG. 4 illustrates a simplified schematic view of the electronics of reflex sight 100, which includes a processor 102, power supply 101 and memory 104. Memory 104 includes a drive loaded with a database and/or instructions for adjusting the intensity of the illumination based on light conditions. Reflex sight 100 includes a forward-aimed sensor 130 and an omnidirectional sensor 132. Based on the sensor signals received from sensors 130, 132, the processor determines an illumination intensity level that is communicated to the controller 120 for varying the illumination of the reticle illumination device 122 of the reflex sight 100. In some embodiments, the controller 120 is an LED controller and the reticle illumination device 122 is an LED system.

Figure 5:
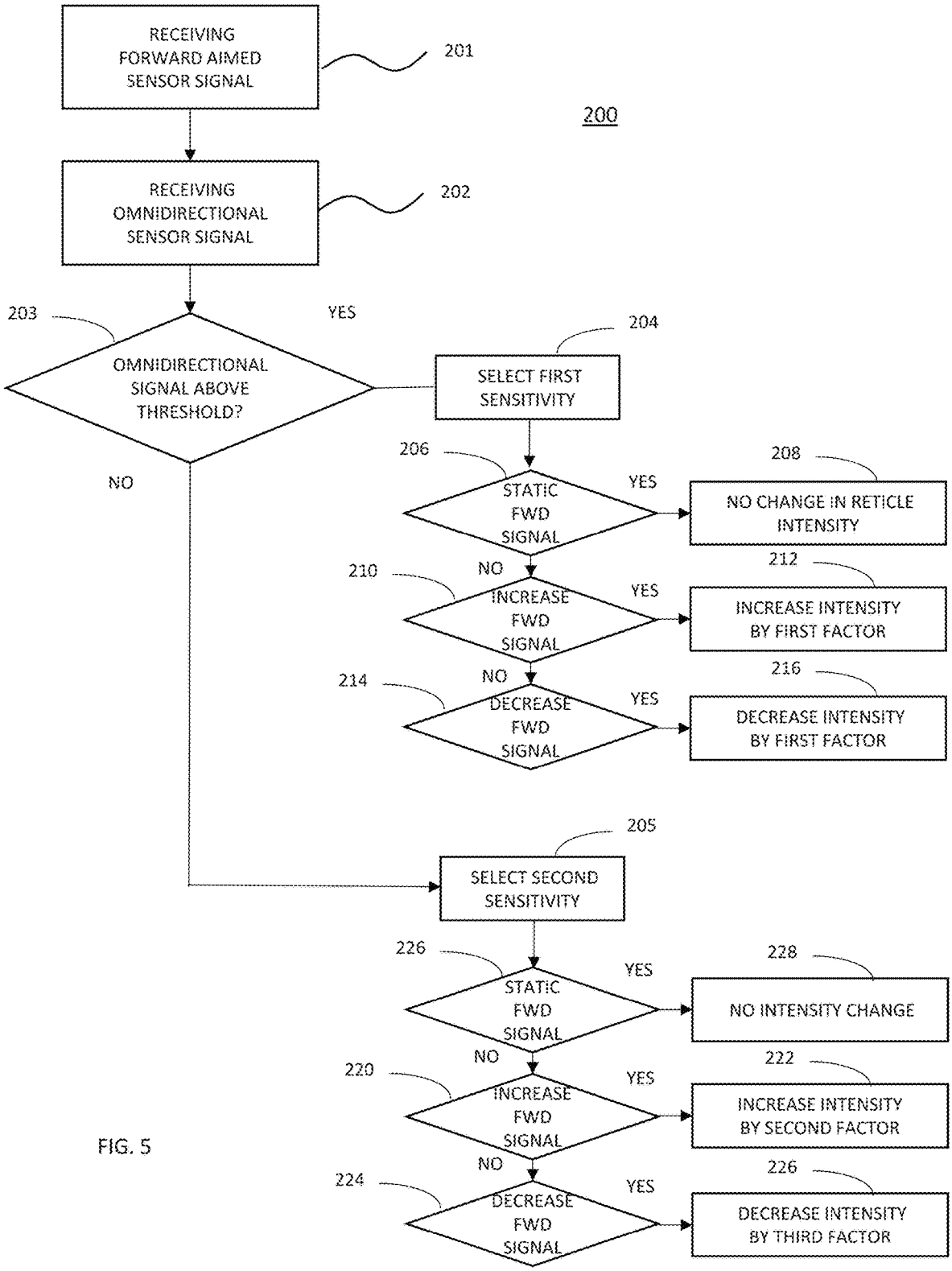
FIG. 5 is a flow diagram of a technique for adjusting the light intensity of the display of the reflex sight of FIG. 1.

A technique 200 for adjusting the intensity of the illumination device 122 is illustrated in FIG. 5. The technique 200 can be implemented in hardware or software, and operated by processor 102. At step 201, the signal from the forward-aimed sensor 30 is received. At step 202, the signal from the omnidirectional sensor 32 is received. It is understood that signals from forward sensor 30 and omnidirectional sensor 32 can be received sequentially or simultaneously. At step 203, a determination is made whether the signal from the omnidirectional sensor 32 (local at the reflex sight) is above a threshold of light intensity, e.g., "bright" lighting conditions. Exemplary bright conditions include bright outdoors, such as full daylight (e.g., 10,752 lx) or partly sunny (e.g., 6,000 lx); bright indoors, such a supermarket or shop environment (e.g., 1,000 lx); bright flashlights or "torches" (e.g., 300 lumen or greater with 60° or less beam spread). Subsequent signals are then received from the forward-aimed sensor and compared with previous sensor readings. If the signal from the omnidirectional sensor is above the threshold (as determined at step 203), then the adjustments to the reticle intensity are made according to a first sensitivity to changes in the light level detected by the forward directional sensor (Step 204). In some embodiments, the first sensitivity is a first proportional factor applied to the forward directional sensor signal. At step 206, if the forward-aimed sensor signal remains static, e.g., unchanged or varies within a minor amount, e.g., less than 10%, the reticle brightness remains unchanged at step 208. The intensity of the reticle primarily relies on the omnidirectional signal. In an exemplary embodiment, the first proportional factor is applied whether the light detected by the forward sensor increases or decreases. At step 210, if the forward-aimed sensor signal increases, reticle brightness is increased by the first proportional factor, such that there is a minor increase in reticle brightness at step 212. At step 214, if the forward-aimed sensor signal decreases, reticle brightness is reduced by the first proportional factor at step 216, such that there is a minor reduction to reticle brightness. In some embodiments, a minor reduction in reticle brightness change would be 1 to 2 settings of 12, or 8-17%.

If the signal from the omnidirectional sensor is below the threshold of light intensity, e.g., "dim" lighting conditions (Step 203), then the adjustments are made according to a second sensitivity to changes in forward directional sensor (Step 205). Exemplary dim conditions include dim outdoors, such as deep twilight (e.g., 1.08 lx) to overcast night (e.g., 0.0001 lx); dim indoors, such as public areas with dark surroundings (e.g., 20 lx) and a basement with no light source (e.g., ≈0 lx). Subsequent signals are received from the forward-aimed sensor and compared with previous sensor readings. In some embodiments, the second sensitivity is a proportional factor applied to the forward directional sensor signal. At step 226, if the forward-aimed sensor signal remains static, e.g., unchanged or varies within a minor amount, e.g., less than 10%, the reticle sensitivity remains unchanged at step 228. The intensity of the reticle primarily relies on the omnidirectional signal.

In some embodiments, the second sensitivity depends on the change in the light level detected by the directional sensor 30. Thus the second sensitivity includes a second proportional factor applied to the directional sensor signal if an increase in the light level is detected by the directional sensor and a third proportional factor applied to the directional sensor signal if an decrease in the light level is detected by the directional sensor Thus, if the directional sensor 30 detects a slight or significant increase in forward light in dim ambient conditions, the reticle adjustment would increase brightness substantially. Examples of a "slight" increase in lighting sensed by the directional sensor include the reflection of flashlight at a relatively distant object (e.g., 25 yds. or greater) or perhaps while sensing bright outdoor light at significant distance (e.g., 100 yds. or greater). Examples of "significant" increase in lighting sensed by the directional sensor include a flashlight reflection at a short distance object (e.g., 10 yds. or less) or a bright outdoor environment such as low angle sunlight or sunlight from behind reflecting off of a bright colored object (e.g., white paint). At step 220, if the forward-aimed sensor signal increases, reticle brightness is increased by the second proportional factor, such that there is a significant increase in reticle brightness at step 222. The system behaves as if aiming from a dark local environment into a brightly lit target environment OR as if a bright flashlight has been deployed.

Conversely, if the omnidirectional sensor 32 detects conditions for a dim environment, there would be little to no reticle adjustment if it senses a decrease in forward direction light. Thus, at step 224, if the forward-aimed sensor signal decreases, reticle brightness is reduced by the third proportional factor at step 226, such that there is a minor reduction to reticle brightness.

Figure 6:
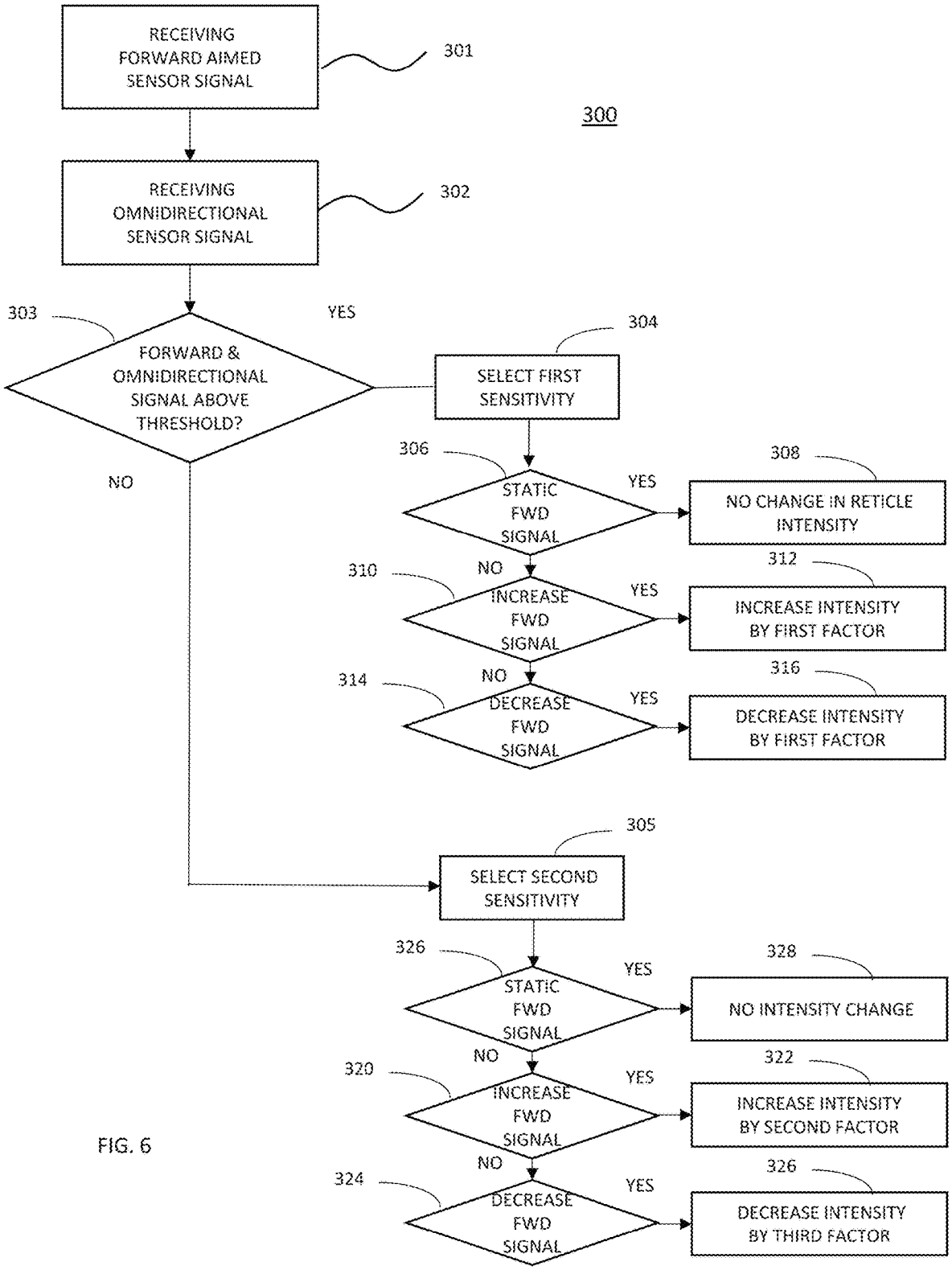
FIG. 6 is a flow diagram of a technique for adjusting the light intensity of the display of the reflex sight of FIG. 1 in accordance with another exemplary embodiment.

In accordance with another embodiment, a technique 300 for adjusting the intensity of the illumination device is illustrated in FIG. 6. The technique 300 is substantially the same as technique 200 with the differences noted herein. At step 301, the signal from the forward-aimed sensor 30 is received and at step 302, the signal from the omnidirectional sensor 32 is received. At step 303, a determination is made whether both the signal from the omnidirectional sensor 32 (local at the reflex sight) and the forward-aimed directional sensor 30 are above a threshold of light intensity, e.g., "bright" lighting conditions. If both the signal from the omnidirectional sensor and the signal from the forward-aimed directional sensor are above the threshold, then the adjustments are made according to a first sensitivity to changes in forward directional sensor. In some embodiments, the first sensitivity is a first proportional factor applied to the forward directional sensor signal (Step 304), which is the same regardless of whether the directional sensor signal increases or decreases. Subsequent signals are then received from the forward-aimed sensor and compared with previous sensor readings. At step 306, if the forward-aimed sensor signal remains static, e.g., unchanged or varies within a minor amount, e.g., less than 10%, the reticle brightness remains unchanged at step 308. The intensity of the reticle primarily relies on the omnidirectional signal. At step 310, if the forward-aimed sensor signal increases, reticle brightness is increased by the first proportional factor, such that there is a minor increase in reticle brightness at step 312. At step 314, if the forward-aimed sensor signal decreases, reticle brightness is reduced by the first factor at step 316, such that there is a minor reduction to reticle brightness. In some embodiments, a minor reduction in reticle brightness change would be 1 to 2 settings of 12, or 8-17%.

If both the signal from the omnidirectional sensor and the signal from directional sensor are below the threshold of light intensity, e.g., "dim" lighting conditions (Step 303), then the adjustments are made according to a second sensitivity to changes in forward directional sensor (Step 305). Subsequent signals are received from the forward-aimed sensor and compared with previous sensor readings. At step 326, if the forward-aimed sensor signal remains static, e.g., unchanged or varies within a minor amount, e.g., less than 10%, the reticle sensitivity remains unchanged at step 328. The intensity of the reticle primarily relies on the omnidirectional signal. The second sensitivity includes a second proportional factor if the directional sensor signal increases and a third proportional factor if the directional sensor signal decreases. Thus, if the directional sensor 30 detects a slight or significant increase in forward light in dim ambient conditions as detected by the omnidirectional sensor 32, the reticle adjustment would increase brightness substantially. At step 320, if the forward-aimed sensor signal increases, reticle brightness is increased by the second factor, such that there is a significant increase in reticle brightness at step 322. Conversely, if the omnidirectional sensor 32 detects conditions for a dim environment, there would be little to no reticle adjustment if it senses a decrease in forward direction light. Thus, at step 324, if the forward-aimed sensor signal decreases, reticle brightness is reduced by the third factor at step 326, such that there is a minor reduction to reticle brightness.

Figure 7:
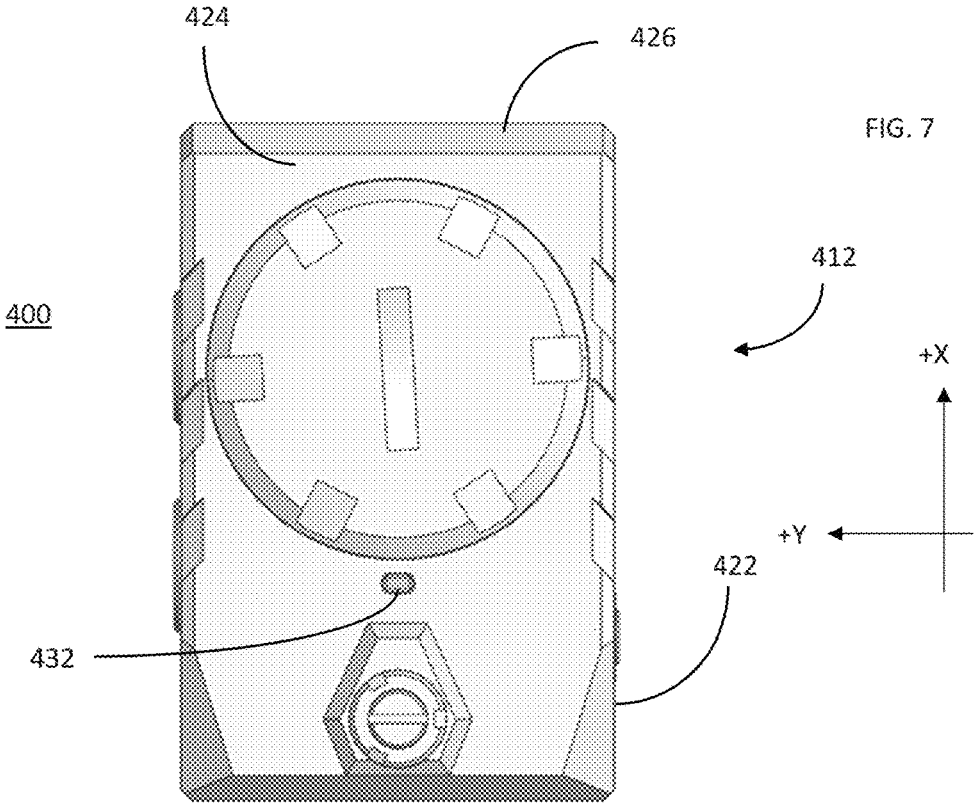
FIG. 7 is a top view of a reflex sight in accordance with another exemplary embodiment of the disclosed subject matter.
Figure 8:
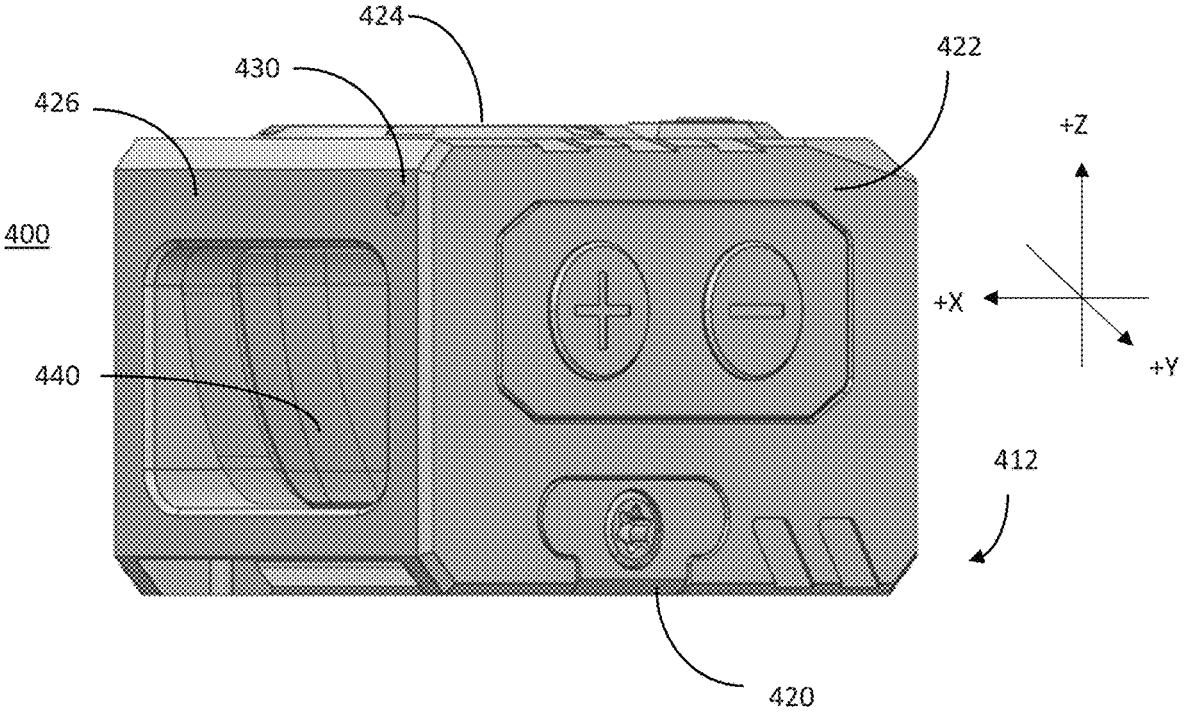
FIG. 8 is a side perspective view from the barrel end of the reflex sight of FIG. 7.

FIGS. 7-8 illustrate another embodiment of a reflex sight 400 in accordance with an exemplary embodiment of the disclosed subject matter. Reflex sight 400 is substantially identical to reflex sight 10 with the significant differences noted herein. Reflex sight 400 includes a housing 412 having side walls 422, an upper wall 424, and lower surface 420 for mounting to a firearm. The forward/barrel side of the housing includes a front edge 426. An optical element 440 is mounted in a generally upright position in a forward portion of housing 412, providing a viewing window for a target field of view. Light emitted from the illumination device (not shown) is directed at a focal point rearward of lens 440 and is reflected rearward toward the user's eye by a dichroic reflection layer or coating of at least one of lenses as collimated light, so that the user perceives the reflected light as an illuminated aiming mark or reticle superimposed on the field of view at infinite distance. Reflex sight 400 includes a forward-aimed directional sensor 430 directed towards the intended target (substantially parallel to the barrel axis) and an omnidirectional sensor 432 directed upwardly, or in a different direction than the forward-aimed directional sensor 430. Forward-aimed sensor 430 is typically a photodiode having a narrow sensing field. In some embodiments, the forward-aimed sensor 430 is positioned on the front edge 426 of the housing 412, e.g., near the corner of the intersection of the side wall 422 and the upper wall 424. Forward-aimed sensor 430 measures lighting condition at distance from a narrower field of view, e.g., the intended target. Omnidirectional sensor 432 is typically a photodiode that receives ambient light over a wider sensing field. In some embodiments, omnidirectional sensor 432 is positioned on the upper surface 424 of the housing 412 and detects local light conditions. By utilizing both a forward, directional sensor 430 and omnidirectional sensor 432, more information may be gathered. When combined with an algorithm for different scenarios of inputs, the system can operate to provide solutions for more lighting conditions.

In some embodiments, the directional sensor is provided in the gun barrel. The sensor signal from the sensor 30 is provided to the processor for comparison with the omnidirectional sensor output via a wired or wireless connection.

In some embodiments, the sight includes an IR illuminator if ambient light conditions are dim. A third sensor is included on the sight to relay IR data In some embodiments, a photovoltaic cell (not shown) is provided on the upper surface to power the omnidirectional sensor.

In some embodiments, the omnidirectional sensor can be located on a helmet or shoulder portion of a uniform. The sensor signal from the omnidirectional sensor is provided to the processor for comparison with the directional sensor output via a wired or wireless connection.

In some embodiments, if the light detected from the directional sensor and/or the omnidirectional sensor, the system may be powered down to save battery life. If the light detected by the directional sensor and/or the omnidirectional sensor is below a threshold, the processor 102 may remain powered down.

In some embodiments, aiming device 100 includes a network adapter 106 and an accelerometer 124. Network adapter 106 provides a computer connection between sight 100, a mobile device and the internet. (FIG. 4) The network adaptor 106 enables computer communication with one or more external computing devices via one or more network protocols. For example, in various embodiments, aiming device 100 can communicate using one or more networks such as a local area network (LAN), a general wide area network (WAN), and/or a public network (e.g., the Internet) via network adapter 106. In certain embodiments, network adaptor 106 communicates wirelessly, transmitting and receiving data over air. For example, in certain embodiments network adapter 106 can communicate using Wi-Fi, BLUETOOTH®, satellite or other suitable form of wireless communication. In some embodiments network adapter 106 can communicate to an external computing device via a wired connection. The processor 102 may transmit data from the aiming device 100 to an external computer, such as a mobile device, laptop or the cloud. Data transmitted can include sensor signals and light intensity settings that have been time-stamped. Network adapter 106 can receive data from other devices, such as from other light sources like flashlights. Data from the accelerometer 124, including gross movement, angle of inclination, spikes from firing cycle recoil, can be transmitted.

Accelerometer data can also be used to determine when to sample the omnidirectional vs. forward sensors. For example, the accelerometer can determine orientation, e.g., the inclination angle, of the sight as well as detect movement of the sight. The "normal" or upright orientation of the sight is assigned a predetermined angle, e.g., 0 degrees. Non-steady or jerky movements are detected by velocity of the sight above a maximum velocity and/or repetitive or cyclic movements above a maximum frequency. When the sight is held upright in the normal orientation and exhibits acceptably steady movement, sensor readings from the directional and omnidirectional sensors are relied upon to sample lighting conditions and to adjust reticle intensity. If the accelerometer determines that the inclination angle exceeds a predetermined range, e.g., 25-90 degrees from the normal orientation, for example the sight is held downward or the sign is experiencing significant movement indicative of non-steady or jerky movements, then sensor readings are not used during those conditions, e.g., the processor suspends operation of the reticle controller and reticle illumination device to adjust reticle intensity. In some embodiments, this selective use of the sensor readings is relied upon if the averaging time of the sensor algorithm is >1 or 2 seconds.

Onboard telemetry, e.g., data generated by sensors on the sight, can be used to moderate the reticle intensity to avoid extreme increases in intensity. For example, if the firearm is holstered, and the sight is left in an automatic mode, (e.g., "litebrite" and "shake-awake" engaged), the holster may block the omnidirectional sensor but leave the forward directional exposed. Some conventional have an exposed window to allow the sight to "breathe" to reduce fogging, which blocks the omnidirectional sensor, but exposes the forward directional sensor. Under such conditions, the sight may provide a substantial increase in reticle intensity when it would be undesirable. An accelerometer can provide orientation data for the sight and prevent the increase of the reticle brightness. Other sensors, such as proximity sensors, can also be used to detect positioning of the sight in a holster.

Figure 9:
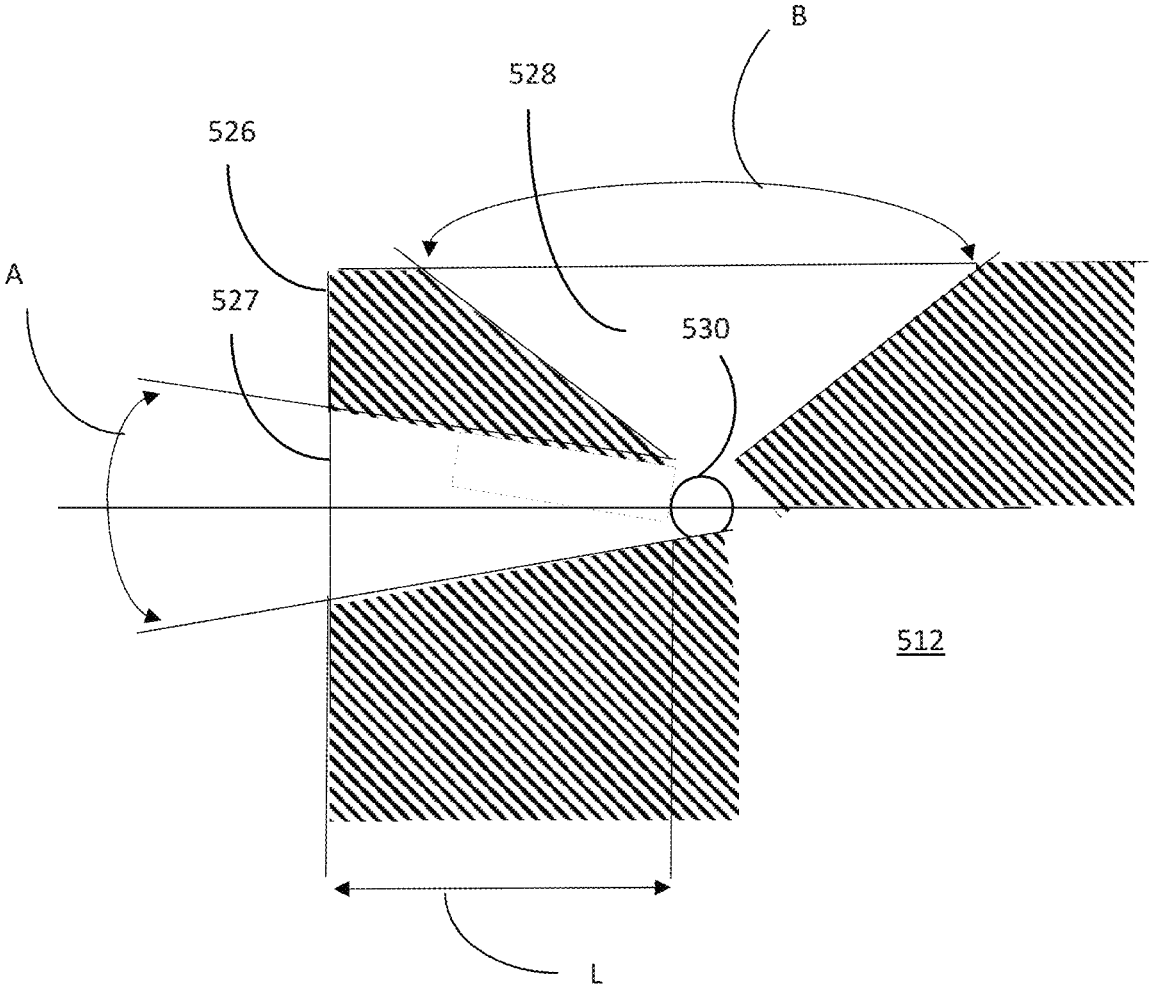
FIG. 9 is a cross-sectional view of a reflex sight in accordance with a further embodiment.

In an exemplary embodiment, a single sensor is provided to obtain ambient light intensity and directional light intensity. For example, FIG. 9 includes a single sensor 530 positioned in the housing 512 of the reflex sight. The sensor may be adjacent to both a narrow aperture 527 having a first smaller angle A for detecting directional light intensity, and a larger aperture 528 having a second larger angle B providing a wide field of view for detecting ambient light intensity. The apertures 527 and 528 may be intermittently covered and uncovered, e.g., by one or more shutters (not shown) to alternately obtain directional and omnidirectional signals. In some embodiments, the sensor output may be capable of being parsed into directional and ambient components. In some embodiments, an adjustable iris is provided to serve as a selectable aperture stop. In some embodiments, a sensor is provided that rotates directions or spins to provide both omnidirectional and directional sensor readings.

The detailed description of aspects of the present disclosure set forth herein refers to the accompanying drawings, which show various embodiments by way of illustration. While these various embodiments are described in sufficient detail to enable those skilled in the art to practice the disclosure, it should be understood that other embodiments can be realized and that logical and mechanical changes can be made without departing from the spirit and scope of the disclosure. Thus, the detailed description herein is presented for purposes of illustration only and not of limitation. For example, the steps recited in any of the method or process descriptions can be executed in any order and are not limited to the order presented. Moreover, references to a singular embodiment can include plural embodiments, and references to more than one component can include a singular embodiment.

Although illustrative embodiments of the present disclosure have been described herein with reference to the accompanying drawings, it is to be understood that the present disclosure is not limited to those precise embodiments, and that various other changes and modifications may be made by one skilled in the art without departing from the scope or spirit of the disclosure.

What is claimed is:

1. An optical device comprising:

a housing defining an optical axis;

an optical element received in the housing;

an illumination device being arranged to project light onto the optical element to display a reticle on the optical element, the reticle having a first light intensity;

a light sensor arrangement defining a first effective detector angle of view providing a first sensor signal based on light intensity in a forward-aimed direction and defining a second effective detector angle of view providing a second sensor signal based on ambient light intensity, the light sensor arrangement being arranged to cooperate with the illumination device to enable adjustment of the light intensity of the reticle to a second light intensity as a function of the first and second sensor signals; and a processor configured to communicate with the light sensor arrangement to adjust the light intensity of the reticle as a function of the first and second sensor signals; wherein the processor is configured to:

determine whether the first sensor signal is static, increasing or decreasing during sequential measurements;

when the second sensor signal is above a first light threshold, operate the light intensity of the reticle according to a first sensitivity; and when the second sensor signal is below a second light threshold, operate the light intensity of the reticle according to a second sensitivity.

2. The optical device of claim 1, wherein the optical device is an optical reflex sight, a riflescope or a prism sight.

3. The optical device of claim 1 wherein the first sensor signal is provided by a directional sensor aimed in a first direction substantially parallel to the optical axis and the second sensor signal is provided by an omnidirectional sensor aimed in a second direction different from the first direction.

4. The optical device of claim 1 wherein the first effective detector angle of view is narrower than the second effective detector angle of view.

5. The optical device of claim 1 wherein the first effective detector angle of view is between 15 and 90 degrees and the second effective detector angle of view is between 120 and 180 degrees.

6. The optical device of claim 1 wherein the first light threshold is the same as the second light threshold.

7. The optical device of claim 1, further comprising an IR sensor.

8. The optical device of claim 1, further comprising a network adapter to transmit data to or receive data from a remote device.

9. The optical device of claim 3 wherein the omnidirectional sensor is powered by a photovoltaic cell.

10. The optical device of claim 3 wherein the omnidirectional sensor is a photovoltaic cell.

11. The optical device of claim 1 further comprising an accelerometer, wherein the accelerometer is configured to detect inclination angle and movement of the optical device and wherein the processor suspends adjustment of the light intensity of the reticle as a function of the first and second sensor signals when the inclination angle exceeds a predetermined angle or non-steady movement is detected.

12. An optical aiming device for mounting on a firearm comprising:

a housing defining a barrel axis;

an optical element received in the housing;

an illumination device being arranged to project light onto the optical element to display a reticle on the optical element, the reticle having a first light intensity;

a light sensor arrangement comprising a directional sensor providing a first sensor signal and an omnidirectional sensor providing a second sensor signal, the light sensor arrangement being arranged to cooperate with the illumination device to enable adjustment of the light intensity of the reticle to a second light intensity as a function of the first and second sensor signals;

wherein the optical aiming device comprises a processor configured to determine whether the first sensor signal is static, increasing or decreasing during sequential measurements.

13. The optical aiming device of claim 12 wherein the optical aiming device is an optical reflex sight, a riflescope or a prism sight.

14. The optical aiming device of claim 12 wherein the directional sensor defines an effective detector angle of view is between 15 and 90 degrees and the omnidirectional sensor defines an effective detector angle of view is between 120 and 180 degrees.

15. The optical aiming device of claim 12 wherein the directional sensor is aimed in a first direction substantially parallel to the barrel axis and the omnidirectional sensor is aimed in a second direction different from the first direction.

16. An optical reflex sight for mounting on a firearm comprising:

a housing defining a barrel axis;

an optical element received in the housing;

an illumination device being arranged to project light onto the optical element to display a reticle on the optical element, the reticle having a first light intensity;

a light sensor arrangement comprising a directional sensor aimed in a direction substantially parallel to the barrel axis providing a first sensor signal and an omnidirectional sensor signal aimed in a second direction providing a second sensor signal, the light sensor arrangement being arranged to cooperate with the illumination device to enable adjustment of the light intensity of the reticle as a function of the first and second sensor signals; and a processor configured to communicate with the light sensor arrangement to operate the light intensity of the display as a function of detected parameters from the directional sensor and the omnidirectional sensor, wherein the processor is configured to determine whether the first sensor signal is static, increasing or decreasing during sequential measurements; and operate the light intensity of the reticle according to a first sensitivity of the first sensor signal when the second sensor signal is above a first light threshold and to operate the light intensity of the reticle according to a second sensitivity of the first sensor signal when the second sensor signal is below a second light threshold.

17. The optical reflex sight of claim 16 wherein when the second sensor signal is above the first light threshold, the processor is configured to operate the light intensity of the reticle according to the first sensitivity to operate the light intensity of the reticle with no change when the first sensor signal is static;

increase the light intensity of the reticle by a first factor when the first sensor signal increases; and decrease the light intensity of the reticle by the first factor when the first sensor signal decreases; and when the second sensor signal is below the second light threshold, operate the light intensity of the reticle according to the second sensitivity to operate the light intensity of the reticle with no change when the first sensor signal is static;

increase the light intensity of the reticle by a second factor applied when the first sensor signal increases; and decrease the light intensity of the reticle according to a third factor when the first sensor signal decreases.

18. The optical device of claim 1 wherein when the second sensor signal is above the first light threshold, the processor is configured to operate the light intensity of the reticle according to the first sensitivity to operate the light intensity of the reticle with no change when the first sensor signal is static;

increase the light intensity of the reticle by a first factor when the first sensor signal increases; and decrease the light intensity of the reticle by the first factor when the first sensor signal decreases; and when the second sensor signal is below the second light threshold, operate the light intensity of the reticle according to the second sensitivity to operate the light intensity of the reticle with no change when the first sensor signal is static;

increase the light intensity of the reticle by a second factor applied when the first sensor signal increases; and decrease the light intensity of the reticle according to a third factor when the first sensor signal decreases.

19. The optical aiming device of claim 12 wherein when the second sensor signal is above a first light threshold, the processor is configured operate the light intensity of the reticle according to a first sensitivity to operate the light intensity of the reticle with no change when the first sensor signal is static;

increase the light intensity of the reticle by a first factor when the first sensor signal increases; and decrease the light intensity of the reticle according by the first factor when the first sensor signal decreases; and when the second sensor signal is below a second light threshold, the processor is configured to operate the light intensity of the reticle according to a second sensitivity to operate the light intensity of the reticle with no change when the first sensor signal is static;

increase the light intensity of the reticle by a second factor when the first sensor signal increases; and decrease the light intensity of the reticle by a third factor when the first sensor signal decreases.

20. The optical device of claim 1 further comprising a proximity sensor.

* * * * *